United States Patent [19]

Nordli

[11] Patent Number: 4,596,359

[45] Date of Patent: Jun. 24, 1986

[54] DEVICE FOR PUNCHING HOLE IN CARDS

[75] Inventor: Per-Ole Nordli, Moss, Norway

[73] Assignee: Trioving A/S, Norway

[21] Appl. No.: 738,954

[22] Filed: May 29, 1985

[30] Foreign Application Priority Data

Jun. 1, 1984 [NO] Norway ..... 842216

[51] Int. Cl.[4] ..... B26F 1/04

[52] U.S. Cl. ..... 234/107; 234/115; 234/131

[58] Field of Search ..... 234/97, 98, 101, 107, 234/108, 111, 112, 115, 114, 116, 131; 83/549, 571

[56] References Cited

U.S. PATENT DOCUMENTS

| | | | |
|---|---|---|---|
| 3,022,000 | 2/1962 | Millis | 234/114 |
| 3,073,519 | 1/1963 | Booth | 234/131 |
| 3,542,284 | 11/1970 | Meagher | 234/115 |

*Primary Examiner*—Frank T. Yost
*Assistant Examiner*—Hien H. Phan
*Attorney, Agent, or Firm*—Darby & Darby

[57] ABSTRACT

A punching device for punching coded key cards and the like comprising a plurality of punches, each of which is selectively movable in respective guide. Balls of ferromagnetic material are positionable in a first punching position and a second passive position. Solenoids with movable cores are arranged to selectively move the balls between the first and second positions.

3 Claims, 2 Drawing Figures

DEVICE FOR PUNCHING HOLE IN CARDS

The present invention relates to a device for punching holes in cards, e.g. coded key cards or the like, comprising a plurality of punches which are selectively movable in guides, a slot for receiving a card blank, and means for moving the punches and card blank with respect to each other for punching holes in the card blank, wherein, associated with each punch, means of ferromagnetic material are arranged, which are positionable in a first position, in which the respective punch is held in active, hole punching condition, and in a second position, in which the punch is held in passive condition, said positionable means at least in the active, hole punching condition being arranged in line with the respective punch and being arranged to selectively limit the movement of the punch in its guide, and further comprising a solenoid with movable core which is arranged to selectively move said positionable means between said first and second positions.

The device is preferably intended for the type of punched cards which are used as key cards and code cards in the type of locks which are described in U.S. Pat No. 4,149,394. Such punched cards have e.g. 32 possible hole positions within a rectangle being as small as 40×45 mm.

It is previously known some types of machines which could be used for punching holes in punched cards of the above mentioned type. Examples of such machines are known from U.S. Pat. Nos. 3,059,844, 3,073,519 and 3,542,284. Common for these is that they can only punch holes in one row at a time because the adjustable means are sufficiently wide to prevent several rows of punches being placed next to each other. As a result, the punched card must be punched in several operations, the card blank being moved stepwise from one row of holes to the next. This makes the hole punching relatively slow and, furthermore, it may be problematic to keep track of where the holes are to be punched in the different rows. Furthermore, the machines are generally relatively noisy and also for this reason they are not very suitable for use e.g. in a hotel reception.

The purpose of the present invention is thus to provide a device of the type mentioned above, which works quickly and preferably without objectional noise. This is obtained according to the invention in that the solenoids are arranged on a slide which is movable transversely of the longitudinal direction of the punches, which slide also has room for the positionable means in their passive, second condition.

In this arrangement it is possible to make the positionable means so slender that the corresponding punches will have room alongside each other in the necessary number for punching all holes in the card in one and the same operation. Furthermore, this arrangement allows locking in one operation all the positionable means present in the active condition.

According to an advantageous embodiment of the invention the solenoids are connected to a micro-processor for their control, the micro-processor being pre-programmed to constantly choose new hole combinations.

In accordance with another adventageous embodiment an element of generally non-magnetic material is arranged between the positionable means and the respective punch.

For the better understanding of the invention it will be described more closely with reference to the examplifying embodiment shown in the appended drawings.

Figure 1:
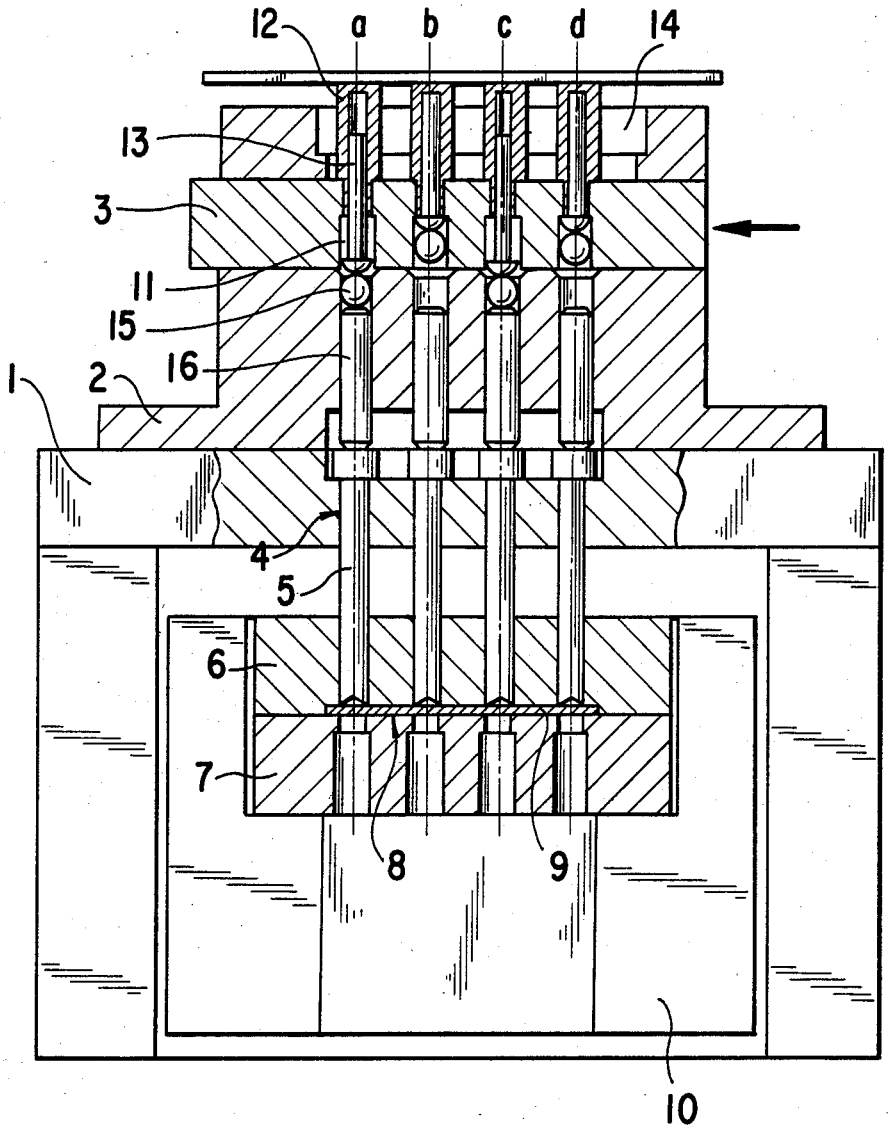
FIG. 1 is a vertical section through a device according to the invention in a first position.
Figure 2:
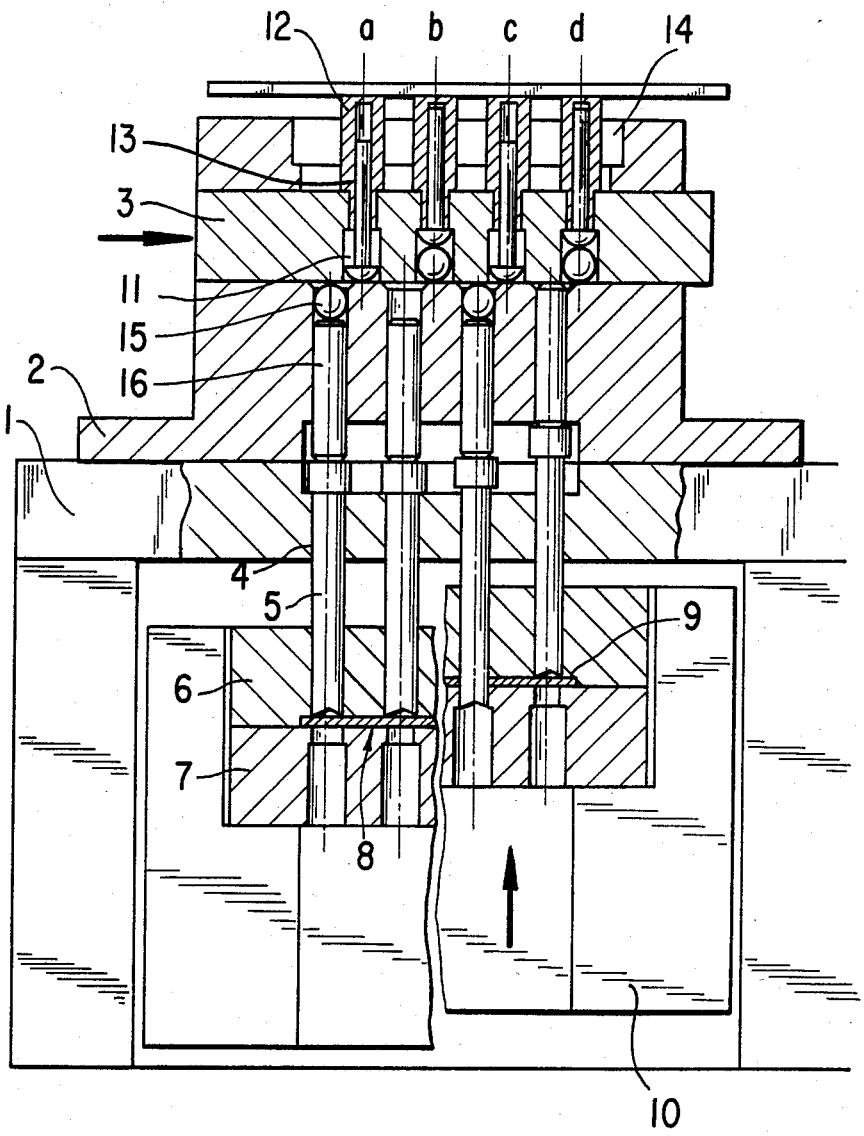
FIG. 2 shows the device in FIG. 1 in a second position.

The device in FIGS. 1 and 2 comprises a frame 1 whereupon is mounted a slide housing 2 for a horizontally movable slide 3. Guides 4 are arranged in the frame for a number of punches 5. It will be understood that several of such rows of punches may lie in front of or behind the drawing plane. The guides 4 continue in the slide housing 2 on the one side and in the stripper 6 on the other side.

The stripper 6 together with the die 7 defines a slot 8 for a card blank 9. The stripper and the die are arranged in a piston 10, which by the aid of means not shown is movable within limits in the axial direction of the punches 5. The upper and lower position of the piston are shown in FIG. 2.

The slide 3 is provided with bores 11 corresponding to the guides 4 in the slide housing 2 and frame 1. In line with each bore 11 a solenoid 12 is mounted having a movable core 13. A recess 14 is made in the top of the slide housing for providing room for the solenoids 12 when the slide 3 is moved horizontally between its outer positions shown in FIGS. 1 and 2, respectively.

With the aid of means not shown and known per se, current may be conducted to each solenoid 12 individually in order to pull the core 13 up into the upper position, e.g. as shown in positions b and d in the figures. Concurrently the core 13 will lift a steel ball 15 and thus move it from the guide 4 in the side housing 2 to the bore 11 in the slide 3. When the current supply is interrupted, the core 13 and ball 15 by means of gravity will move to their lower position, e.g. as shown for the positions a and c in the figures. A pin 16 of non-magnetic material is arranged between the ball 15 and the punch 5 in order to prevent the possibility of magnetizing the punch 5 and consequential operational disorders following long time use. In this embodiment the above-mentioned adjustable means are constituted by the ball 15, while the solenoid 12 and the core 13 are part of the activating means.

When the device according to the invention is to be used, its starting position will be as shown in FIG. 1. A card blank 9 will be placed in the slot 8 between the stripper 6 and the die 7. Current is provided to the solenoids 12 for those positions where the holes are not to be punched, whether this is done manually or by means of a micro-processor. In the example shown this is positions b and d. The remaining solenoids a and c are currentless.

Thereafter, the slide 3 is moved towards the right to the position shown in FIG. 2. This may take place manually or by means of a further solenoid (not shown). It will be seen that the punches for those positions (a and c) where holes are to be punched, are locked in position because the ball 5 fills the space above the pin 16 and is prevented from moving by the slide 3. In the remaining positions the punches 5 and pins 16 have a certain freedom of axial movement.

When the holes are to be punched in the card blank, the piston 10 is moved upwards, e.g. manually or by means of other suitable means (not shown), to the position shown to the right in FIG. 2. Herewith the locked punches will punch holes in the card blank, while the remaining punches will be pushed upwards together with the pins 16 without noticable resistance. Thereafter, the piston 10 is moved back into its lower position so that the stripper 6 pulls the ready-punched card off from the locked punches.

Then the ready card is taken out from the device and a new card blank is put in place. If this is to be provided with another combination, the slide 3 is moved back to its starting position as shown in FIG. 1, and the new combination is set in the solenoids 12, whereupon the operations described above are repeated.

It will be understood that the invention may be varied in a number of ways within the frame of the following claims. Thus, the activatable means do not have to be constituted by solenoids with movable cores, but may e.g. be envisioned as pneumatic cylinders where the cylinder itself will correspond to the solenoid and the piston correspond to the core. In this case it may be adventageous to turn the device partly upside-down so that the punches and balls are brought in passive condition (positions b and d) by means of gravity, possibly aided by spring force. One can also envision the solenoids being replaced by manually manipulatable means which can be locked against a spring force in depressed condition, e.g. like the mechanism which is common in ball point pens for axially moving and locking the cartridge. In this case a movable slide would not be necessary.

I claim:

1. A device for punching holes in cards comprising a plurality of punches (5) which are selectively movable in guides (4), a slot (8) for receiving a card blank (9), and means (10) for moving the punches (5) and card blank (9) with respect to each other for punching holes in the card blank, wherein, associated with each punch, means (15) of ferromagnetic material are arranged, which are positionable in a first position (a, c), in which the respective punch is held in active, hole punching condition, and in a second position (b, d), in which the punch is held in passive condition, said positionable means (15) at least in the active, hole punching condition being arranged in line with the respective punch (5) and being arranged to selectively limit the movement of the punch in its guide (4), and further comprising a solenoid (12) with movable core (13) which is arranged to selectively move said positionable means (15) between said first and second positions, characterized in that the solenoids (12) are arranged on a slide (3) which is movable transversely of the longitudinal direction of the punches (5), which slide (3) also has room (11) for the positionable means (15) in their passive, second condition.

2. A device according to claim 1, characterized in that the solenoids (12) are connected to a micro-processor for their control, the micro-processor being pre-programmed to constantly choose new hole combinations.

3. A device accoding to claim 1, characterized in that between said positionable means (15) and the respective punch (5) an element (16) of generally non-magnetic material is arranged.

* * * * *